US008783986B1

(12) United States Patent
DeFrancisci

(10) Patent No.: US 8,783,986 B1
(45) Date of Patent: Jul. 22, 2014

(54) ERASER DEVICE FOR WRITING IMPLEMENT

(71) Applicant: Rosemary DeFrancisci, West Melbourne, FL (US)

(72) Inventor: Rosemary DeFrancisci, West Melbourne, FL (US)

( * ) Notice: Subject to any disclaimer, the term of this patent is extended or adjusted under 35 U.S.C. 154(b) by 0 days.

(21) Appl. No.: 14/073,964

(22) Filed: Nov. 7, 2013

Related U.S. Application Data

(60) Provisional application No. 61/751,074, filed on Jan. 10, 2013.

(51) Int. Cl.
*B43K 25/00* (2006.01)
*B43L 19/00* (2006.01)
*B43K 29/02* (2006.01)

(52) U.S. Cl.
CPC ..... *B43L 19/0075* (2013.01); *B43K 29/02* (2013.01)
USPC ..... 401/52; 15/424; 15/427

(58) Field of Classification Search
USPC ..... 401/52, 195; 15/424–428, 434
See application file for complete search history.

(56) References Cited

U.S. PATENT DOCUMENTS

| | | | | | |
|---|---|---|---|---|---|
| 78,158 | A | | 5/1868 | Toof | |
| 384,563 | A | | 6/1888 | Cross | |
| 428,324 | A | | 5/1890 | Thomas | |
| 461,205 | A | * | 10/1891 | Faber | 15/434 |
| 578,190 | A | * | 3/1897 | Barr | 15/426 |
| 606,551 | A | | 6/1898 | Huffman | |
| 833,744 | A | | 10/1906 | Koehler | |
| 948,822 | A | | 2/1910 | McSweeney | |
| 1,121,318 | A | | 12/1914 | Allen | |
| 1,273,697 | A | | 7/1918 | Vidal | |
| 1,339,707 | A | * | 5/1920 | Lazarides | 15/428 |
| 1,358,568 | A | | 11/1920 | Moore | |
| 1,473,090 | A | | 11/1923 | Ferry | |
| 1,550,770 | A | | 8/1925 | Akira | |
| 1,569,742 | A | | 1/1926 | Goerling | |
| 2,057,792 | A | | 10/1936 | Sakai | |
| 4,899,419 | A | | 2/1990 | Saleen | |
| 5,555,602 | A | | 9/1996 | Leamond | |
| 6,732,407 | B2 | | 5/2004 | Weiss | |

* cited by examiner

*Primary Examiner* — David Walczak
(74) *Attorney, Agent, or Firm* — Allen, Dyer, Doppelt, Milbrath & Gilchrist, P.A.

(57) ABSTRACT

An eraser device for a writing implement includes an eraser body having eraser material on at least one end thereof, and an attachment loop having a loop end connecting a pair of spaced legs, respective leg ends of the spaced legs being attached to the eraser body, the attachment loop being dimensioned to accommodate a shaft of the writing implement therein between the spaced legs and the loop end. The eraser body can be a recycled pencil stub.

18 Claims, 1 Drawing Sheet

ERASER DEVICE FOR WRITING IMPLEMENT

CROSS-REFERENCE TO RELATED APPLICATION

This application claims the benefit of U.S. Provisional Application Ser. No. 61/751,074, filed on Jan. 10, 2013, the contents of which are herein incorporated by reference in their entirety.

FIELD OF THE INVENTION

The present invention relates to erasable writing implements, and more particularly, to erasers connected thereto.

BACKGROUND OF THE INVENTION

Erasable writing implements, the most common being pencils, are well known and widely used. In the traditional pencil, as in most erasable implements, the eraser is located on the opposite end of the pencil from the point. Thus, erasing requires the writer to rotate the pencil a complete 180 degrees to use the eraser. Alternately, a separate eraser unconnected with the pencil is sometimes employed. When using this type of eraser, the writer usually puts down the pencil and picks it up again when done erasing. Also, being unconnected to the pencil, these erasers can be harder to keep track of, and are often unavailable when needed.

Some attempts have been made to provide an eraser that is connected to the pencil, but does not require the pencil to be put down or flipped completely over. Some examples include the devices disclosed in U.S. Pat. No. 7,732,407 and U.S. Pat. No. 1,121,318. While these devices offer certain advantages, further improvements are possible.

SUMMARY OF THE INVENTION

In view of the foregoing, it is an object of the present invention to provide an improved eraser device for a writing implement. According to an embodiment of the invention, an eraser device for a writing implement includes an eraser body having eraser material on at least one end thereof, and an attachment loop having a loop end connecting a pair of spaced legs, respective leg ends of the spaced legs being attached to the eraser body, the attachment loop being dimensioned to accommodate a shaft of the writing implement therein between the spaced legs and the loop end. The eraser body can be a recycled pencil stub.

According to a further embodiment, a writing implement system includes the eraser device in combination with the writing implement.

According to a method aspect, the eraser device is used by sliding the attachment loop over the shaft of the writing implement, such that the shaft of the writing implement is retained between spaced legs of the attachment loop. The attachment loop is moved along the shaft to position the eraser body of the eraser device carrying eraser material adjacent to a writing end of the writing implement.

According to a further aspect of the present invention, pointed prongs on respective ends are used to form holes in the eraser body, by which means the attachment loop is pivotably connected to the eraser body. Advantageously, the eraser body can be a recycled pencil stub.

These and other objects, aspects and advantages of the present invention will be better appreciated in view of the drawings and detailed description of preferred embodiments.

DETAILED DESCRIPTION OF PREFERRED EMBODIMENTS

Figure 1:
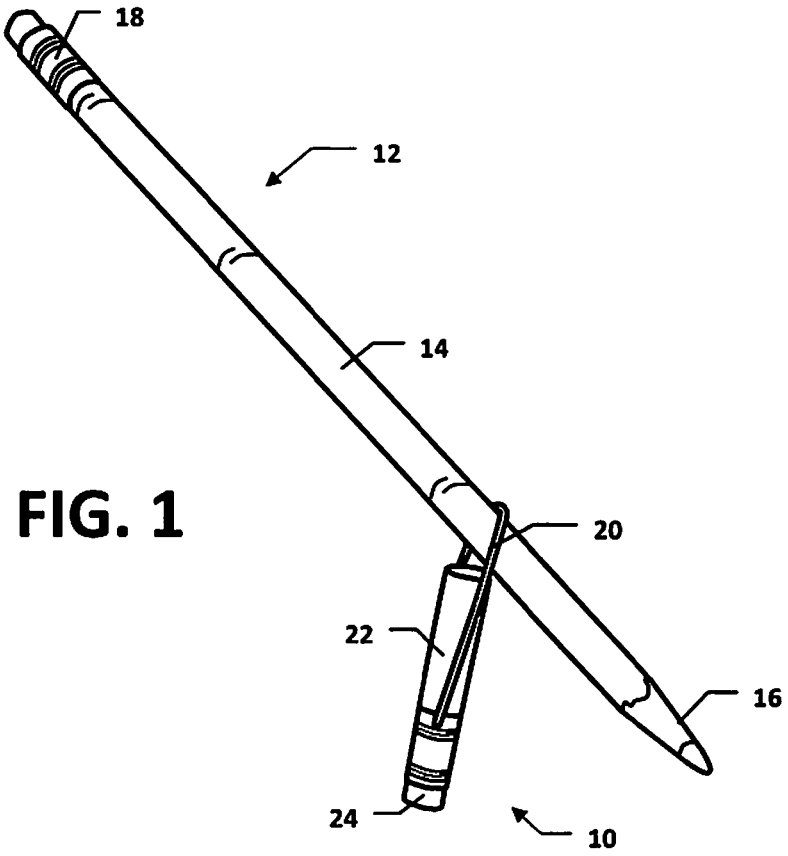
FIG. 1 is a perspective view of a writing implement with an eraser device connected thereto, according to an embodiment of the present invention.
Figure 2:
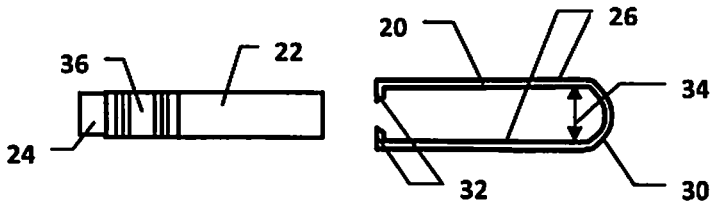
FIG. 2 is a partially exploded top view of the eraser device of FIG. 1.
Figure 3:
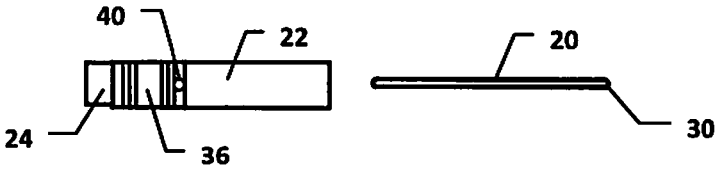
FIG. 3 is a partially exploded side view of the eraser device of FIG. 1.

Referring to FIG. 1-3, according to an embodiment of the present invention, an eraser device 10 is slidably connected to a writing implement 12. More particularly, the eraser device 10 is slidably connected about a shaft 14 of the writing implement and movable towards and away from a writing end 16 thereof. The eraser device 10 can be installed on, and removed from, the implement 12 by sliding it over the writing end 16 or the opposite end 18 of the shaft 14.

The eraser device 10 includes an attachment loop 20 and an eraser body 22. The eraser body 22 includes eraser material 24 on at least one end thereof. The attachment loop 20 is slidably connected to the implement 12 by a slight interference fit that allows sliding when desired but will maintain the position of the eraser device 10 when not actively being moved. Alternately, the attachment loop 20 can be dimensioned to closely fit the implement 12 while being free-sliding. In normal operation, the writer's hand on the implement 12 would prevent the eraser device 10 from sliding off. Advantageously, the attachment loop is pivotably connected to the eraser body 22.

The attachment loop 20 includes a pair of spaced legs 26 connected at a loop end 30 and terminating in inwardly directed prongs 32. The loop end 30 preferably has a loop diameter 34 approximately equal to, or slightly less than, a diameter of the shaft 14 (for example, approximately equal to, or slightly less than, the diameter of a standard No. 2 pencil). The legs 26 are preferably elastically deformable apart from each other, facilitating the interference fit with the shaft 14. The prongs 32 can be pointed to facilitate insertion into the eraser body 22.

The eraser body 22 preferably has a diameter approximately equal to the diameter of the shaft 14. In the depicted embodiment, the eraser body 22 is formed from a used pencil stub, with the eraser material 24 connected to an end thereof by a crimped metal band 36. Holes 40 on opposite sides of the eraser body 22 pivotably receive the prongs 32. Advantageously, the holes 40 can be formed by forcible application of the prongs 32.

In use of the erasing device 10, the attachment loop 20 is connected to the eraser body 22. The attachment loop is then slid over an end 16, 18 of the implement 12 and moved to place the eraser material 24 in a writer-preferred location adjacent the writing end 16. When an erasure is desired, the writer need only grasp the eraser body 22 and effect a minimal orientation change in the shaft 14 of the writing implement 12. Writing may be quickly and readily resumed when the erasure is complete. When use of the writing implement is no longer desired, the erasing device 10 can be retained on the implement 12.

In view of the foregoing, it will be appreciated that the present invention facilitates the erasing process, minimizing pencil movement required for an erasure and offering great flexibility in eraser placement. Additionally, the present invention can offer a method for extending the usefulness of otherwise wasted pencil stubs. In addition to allowing the use of the eraser material of such stubs, the present invention could also be employed to connect the writing end of stubs to another writing implement. For example, a writer could then more easily shift between writing in pencil and pen, or between different line weights, colors or the like.

The above described embodiments are presented for illustrative and exemplary purposes; the present invention is not necessarily limited thereto. Rather, those skilled in the art will appreciate that various modifications, as well as adaptations to particular circumstances, will fall within the scope of the invention herein shown and described.

What is claimed is:

1. An eraser device for a writing implement, the eraser device comprising:

an eraser body having eraser material on at least one end thereof; and an attachment loop having a loop end connecting a pair of spaced legs, respective leg ends of the spaced legs being attached to the eraser body, the attachment loop being dimensioned to accommodate a shaft of the writing implement therein between the spaced legs and the loop end;

wherein the eraser body is pivotably connected between the respective leg ends.

2. The eraser device of claim 1, wherein the eraser body is a pencil stub.

3. The eraser device of claim 1, wherein the spaced legs are elastically deformable from each other and the loop end has diameter slightly less than a diameter of the shaft of the writing implement, such that the eraser device is retainable in place on the shaft of the writing implement by an interference fit while still allowing sliding movement when pushed.

4. The eraser device of claim 1, wherein the diameter of the loop end is slightly less than a diameter of a number two pencil.

5. The eraser device of claim 1, wherein the respective leg ends are received in respective holes on opposite sides of the eraser body.

6. The eraser device of claim 5, wherein the respective leg ends include inwardly directed prongs that are received in the respective holes.

7. The eraser device of claim 6, wherein the inwardly directed prongs are pointed.

8. The eraser device of claim 7, wherein the inwardly directed prongs are hard enough, relative to the eraser body, to form the respective holes therein.

9. A writing implement system comprising:

a writing implement having a shaft; and an eraser device having an eraser body with eraser material on at least one end thereof, and an attachment loop having a loop end connecting a pair of spaced legs, respective leg ends of the spaced legs being attached to the eraser body, the attachment loop accommodating the shaft of the writing implement therein between the spaced legs and the loop end.

10. The writing implement system of claim 9, wherein the eraser device is retained in place on the shaft of the writing implement by an interference fit with the attachment loop, and is slidable along the shaft upon application of force to the eraser device.

11. The writing implement system of claim 9, wherein the eraser body is pivotably connected between the respective leg ends.

12. The writing implement system of claim 9, wherein the respective leg ends include inwardly directed prongs that are received in respective holes on opposite sides of the eraser body.

13. The writing implement system of claim 12, wherein the inwardly directed prongs are pointed.

14. A method of using an eraser device with a writing implement, the method comprising:

connecting an attachment loop of the eraser device to an eraser body of the eraser device carrying eraser material;

sliding the attachment loop over a shaft of the writing implement such that the shaft of the writing implement is retained between spaced legs of the attachment loop; and moving the attachment loop along the shaft of the writing implement to position the eraser body adjacent to a writing end of the writing implement;

wherein connecting the attachment loop to the eraser body includes inserting prongs on respective ends of the spaced leas into respective holes on the eraser body.

15. The method of claim 14, wherein connecting the attachment loop to the eraser body further includes forming the respective holes with the prongs.

16. The method of claim 15, wherein the eraser body is a pencil stub.

17. The method of claim 14, wherein the writing implement is a number two pencil.

18. An eraser device for a writing implement, the eraser device comprising:

an eraser body having eraser material on at least one end thereof; and an attachment loop having a loop end connecting a pair of spaced legs, respective leg ends of the spaced legs being attached to the eraser body, the attachment loop being dimensioned to accommodate a shaft of the writing implement therein between the spaced legs and the loop end;

wherein the eraser body is a pencil stub.

* * * * *